US007659916B2

(12) United States Patent
Sakurai et al.

(10) Patent No.: US 7,659,916 B2
(45) Date of Patent: Feb. 9, 2010

(54) HEATING UNIT, ERASING DEVICE, AND INFORMATION ERASING AND RECORDING APPARATUS

(75) Inventors: Hideo Sakurai, Shizuoka (JP); Tadafumi Tatewaki, Shizuoka (JP); Satoshi Arai, Shizuoka (JP); Naoki Yoshida, Tokyo (JP)

(73) Assignees: Ricoh Company, Ltd., Tokyo (JP); Wedg Co., Ltd., Tokyo (JP)

( * ) Notice: Subject to any disclaimer, the term of this patent is extended or adjusted under 35 U.S.C. 154(b) by 0 days.

(21) Appl. No.: 12/062,928

(22) Filed: Apr. 4, 2008

(65) Prior Publication Data

US 2008/0246829 A1 Oct. 9, 2008

(30) Foreign Application Priority Data

Apr. 5, 2007 (JP) ..... 2007-099383

(51) Int. Cl.
*B41J 25/316* (2006.01)

(52) U.S. Cl. ..... 347/198; 400/120.17

(58) Field of Classification Search ..... 347/197, 347/198, 171; 400/102.16, 120.17
See application file for complete search history.

(56) References Cited

U.S. PATENT DOCUMENTS

| | | | |
|---|---|---|---|
| 2002/0080223 | A1 | 6/2002 | Connor |
| 2004/0080604 | A1 | 4/2004 | Ito |
| 2005/0271441 | A1 | 12/2005 | Bouverie et al. |
| 2008/0062236 | A1 | 3/2008 | Sakurai et al. |
| 2008/0062237 | A1 | 3/2008 | Sakurai et al. |

FOREIGN PATENT DOCUMENTS

| | | |
|---|---|---|
| CN | 2430278 | 5/2001 |
| EP | 1 516 737 A1 | 3/2005 |
| JP | 55-154198 | 12/1980 |
| JP | 5-124360 | 5/1993 |
| JP | 2003-94699 | 4/2003 |
| JP | 2003-317899 | 11/2003 |
| JP | 2004-17572 | 1/2004 |
| JP | 3558998 | 5/2004 |
| JP | 2004-268256 | 9/2004 |
| JP | 3592634 | 9/2004 |

*Primary Examiner*—Huan H Tran
(74) *Attorney, Agent, or Firm*—Oblon, Spivak, McClelland, Maier & Neustadt, L.L.P.

(57) ABSTRACT

A heating unit is disclosed that heats a heat-sensitive medium. The heating unit includes a heat generating body that converts electric energy into heat energy; a fixed member to which the heat generating body is fixed; and a holding member that directly holds the fixed member while contacting at least a part of the fixed member.

11 Claims, 10 Drawing Sheets

HEATING UNIT, ERASING DEVICE, AND INFORMATION ERASING AND RECORDING APPARATUS

BACKGROUND OF THE INVENTION

1. Field of the Invention

The present invention relates generally to heating units, erasing devices, and information erasing and recording apparatuses and, more specifically, to a heating unit that heats a heat-sensitive recording medium, an erasing device that erases information recorded on a heat-sensitive recording medium, and an information erasing and recording apparatus that erases and records information from and on a heat-sensitive recording medium.

2. Description of the Related Art

In recent years and continuing to the present, attention is being given to a reversible heat-sensitive recording medium (hereinafter referred to as a heat-sensitive recording medium), on and from which information can be repeatedly recorded and erased, from the viewpoint of protecting the environment and recycling. A heat-sensitive recording medium (see Patent Document 1) capable of reversibly assuming transparent and cloudy states using light scattering variations of a polymer membrane in which organic low molecular crystal particles are dispersed and another heat-sensitive recording medium (see Patent Document 2) having a recording layer coated with a leuco dye capable of reversibly assuming color optical and erasing states are recording media on and from which information can be recorded and erased by applying proper heat to the recording media to make the recording layers relatively colored or decolored.

In order to record information on a heat-sensitive recording medium, it is necessary to erase the previous information recorded on the heat-sensitive recording medium in advance. Therefore, in a thermal printer or the like, the heat-sensitive recording medium is generally heated by a substrate (hereinafter referred to as a ceramic substrate) made, for example, of a ceramic having low heat conductivity and a thermal head having a heating element formed on the surface of the substrate so that the previous information is erased in advance. However, because the ceramic substrate is more fragile than metals, etc., it is difficult to fix the ceramic substrate to equipment or the like using screws or bolts. For this reason, the thermal head attached to a thermal printer is held with the entire surface on one side of the ceramic substrate bonded on a base made of metals, heat-resistant resins, or the like. As a result, heat is disadvantageously transferred from the ceramic substrate to the base through an adhesive layer, so that it is necessary to use a heat-resistant adhesive. Moreover, where the ceramic substrate and the base have different thermal expansion coefficients, it is foreseen that aging degradation such as poor bonding and breakage of the ceramic substrate may occur over time due to the repetitive stopping operations of the apparatus or the like.

Patent Document 1: JP-A-55-154198

Patent Document 2: JP-A-5-124360

SUMMARY OF THE INVENTION

The present invention has been made in view of the above circumstances, and it may provide a heating unit capable of efficiently heating a heat-sensitive recording medium while realizing reduced manufacturing costs of an apparatus.

Furthermore, a preferred embodiment the present invention may provide an erasing device capable of accurately erasing information recorded on a heat-sensitive recording medium while realizing reduced manufacturing costs of the apparatus.

Furthermore, an embodiment of the present invention may preferably provide an information erasing and recording apparatus capable of accurately erasing and recording information from and on a heat-sensitive recording medium while realizing reduced manufacturing costs of the apparatus.

According to a first aspect of the present invention, a heating unit is provided that heats a heat-sensitive medium. The heating unit comprises a heat generating body that converts electric energy into heat energy; a fixed member to which the heat generating body is fixed; and a holding member that directly holds the fixed member while contacting at least a part of the fixed member.

According to this configuration, the heating unit includes the fixed member to which the heat generating body is fixed, and the fixed member is directly held by the holding member without using an adhesive or the like. Accordingly, the structure of an apparatus is simplified and degradation over time is reduced, thereby making it possible to realize reduced manufacturing costs of the apparatus. Furthermore, by making a contact area between the fixed member to which the heat generating body is fixed and the holding member small, the amount of heat transferred from the heat generating body through the fixed member can be reduced, thereby making it possible to efficiently heat the heat-sensitive medium.

According to a second aspect of the present invention, an erasing device is provided that erases information recorded on a heat-sensitive recording medium heat-reversibly developing and erasing a color. The erasing device comprises the heating unit according to the embodiment of the present invention that heats the heat-sensitive recording medium to erase the information; and a moving device that moves the heat-sensitive recording medium relative to the heating unit.

According to this configuration, the information recorded on the heat-sensitive recording medium is erased using the heating unit according to the embodiment of the present invention. Accordingly, the heat-sensitive recording medium can be uniformly heated, thereby making it possible to evenly erase the information recorded on the heat-sensitive recording medium.

According to a third aspect of the present invention, an information erasing and recording apparatus is provided that erases and records information from and on a heat-sensitive recording medium heat-reversibly developing and erasing a color. The information erasing and recording apparatus comprises the erasing device according to the embodiment of the present invention that heats the heat-sensitive recording medium to erase information recorded on the heat-sensitive recording medium; and a recording device that records other information on the heat-sensitive recording medium from which the previous information has been erased by the erasing device.

According to this configuration, in the erasing device, the information recorded on the heat-sensitive recording medium is erased using the erasing device according to the embodiment of the present invention. Accordingly, it is possible to evenly erase the recorded information. Furthermore, in the recording device, other information is recorded on the heat-sensitive recording medium from which the previous information has been evenly erased. Accordingly, it is possible to accurately record the information.

Other objects, features and advantages of the present invention will become more apparent from the following detailed description when read in conjunction with the accompanying drawings.

DETAILED DESCRIPTION OF THE PREFERRED EMBODIMENTS

Figure 1:
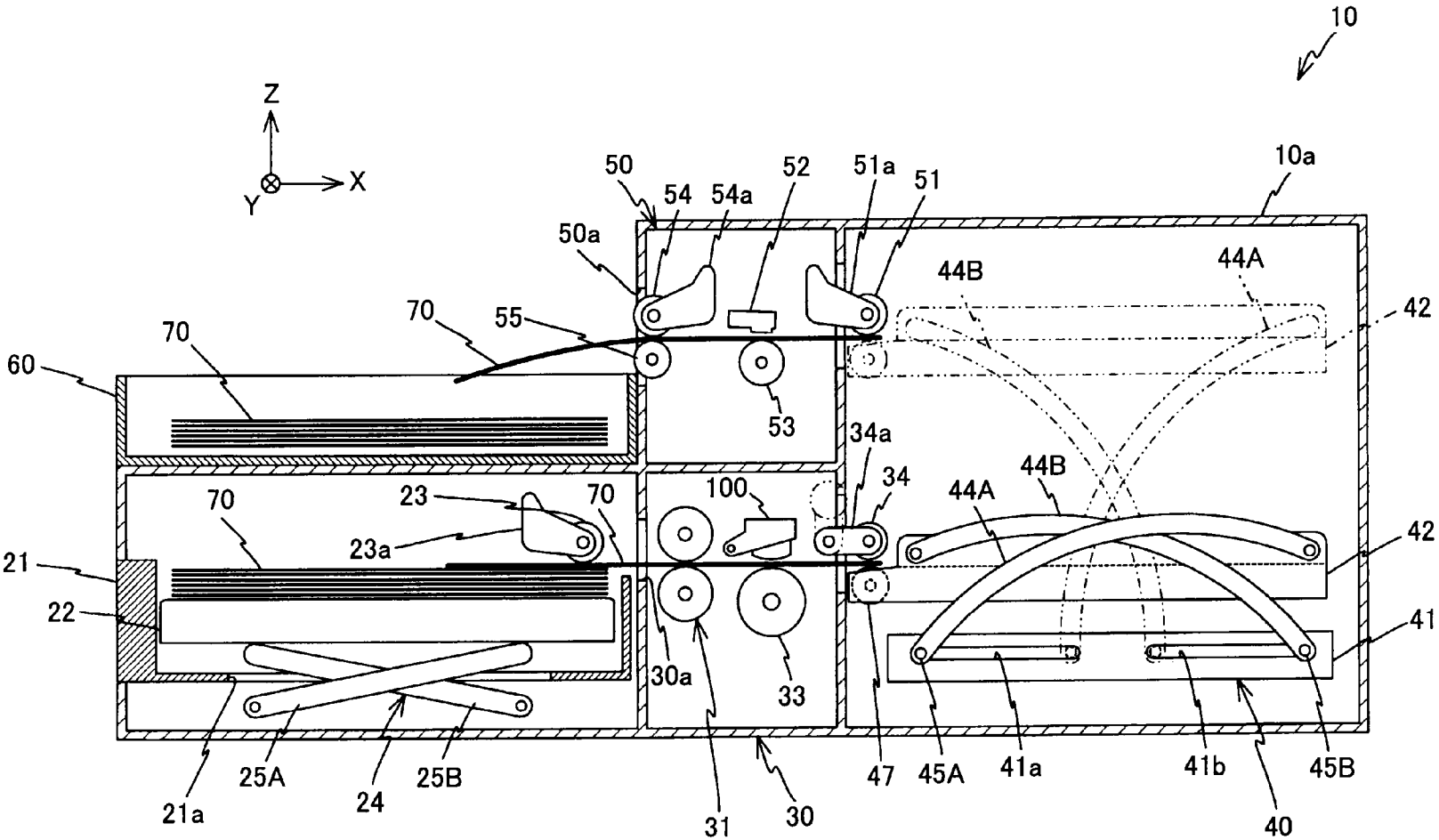
FIG. 1 shows a schematic configuration of a printer 10 according to an embodiment of the present invention.

Referring to FIGS. 1 through 10B, a description is made of an embodiment of the present invention. FIG. 1 shows a schematic configuration of a printer 10 according to the embodiment of the present invention. The printer 10 is a thermal printer capable of erasing and recording information from and on a recording card 70 as an example. As shown in FIG. 1, the printer 10 includes an erasing device 30, a recording device 50, a lifter 40, a sheet feeding cassette 21, a lifting and lowering mechanism 24, a sheet feeding roller 23, a sheet discharging tray 60, a housing 10*a* that accommodates the above parts, and the like.

Figure 2:
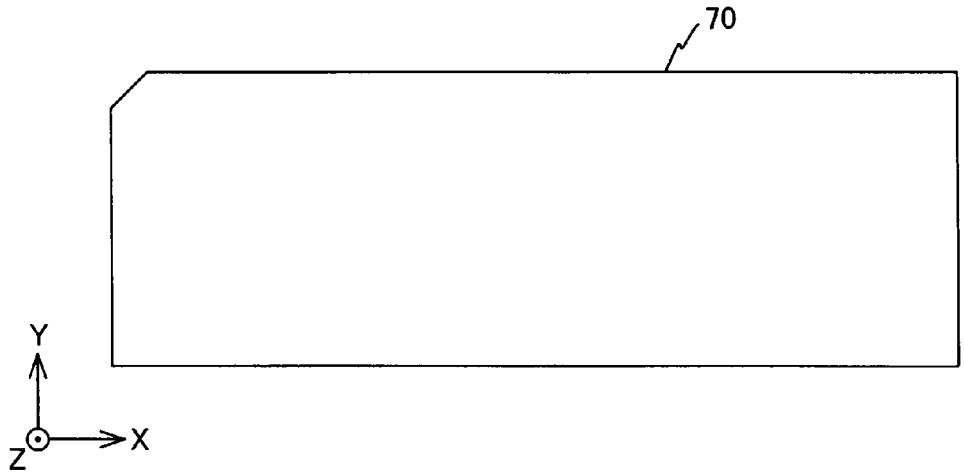
FIG. 2 is a diagram showing a recording card 70.

As shown in a schematic diagram of FIG. 2, the recording card 70 has its longitudinal direction oriented in the X-axis direction. The recording card 70 includes a base material as a base and a recording material bonded onto the upper surface (surface on the positive Z-side) of the base material.

Figure 3:
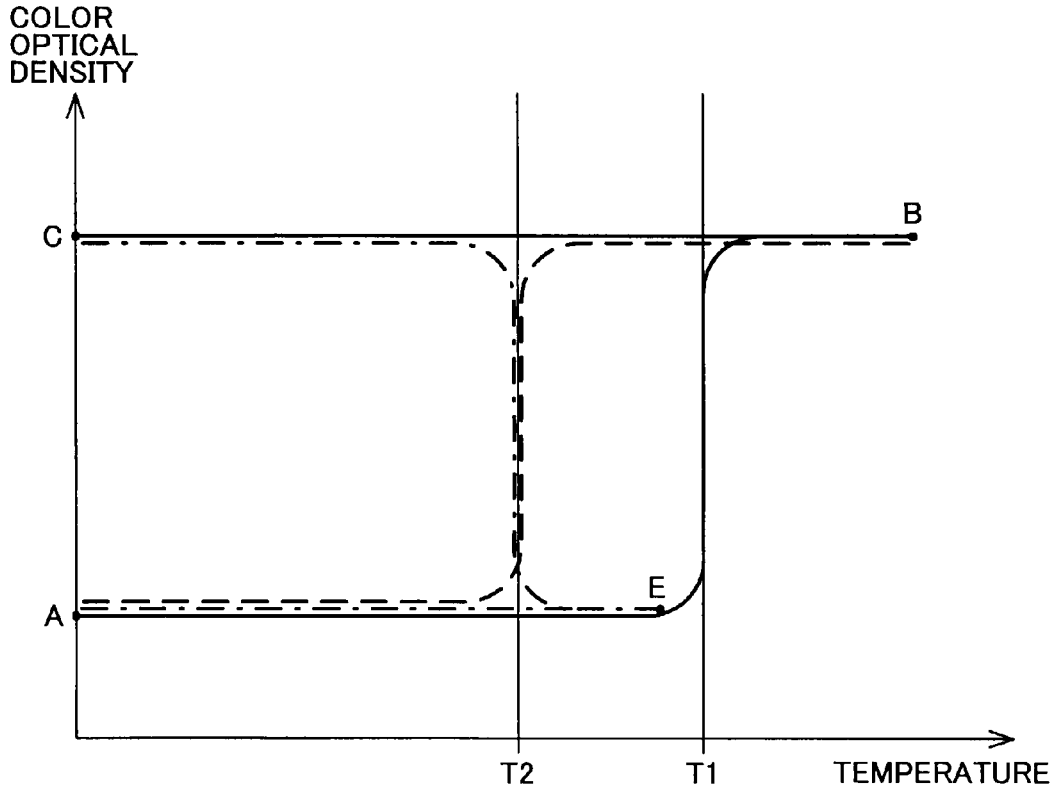
FIG. 3 is a diagram showing the heat-sensitive characteristics of the recording card 70.

The recording material is a reversible heat-sensitive recording medium capable of erasing and developing colors with a thermal head and forming a relative color optical state by making use of differences in heating temperatures and cooling rates after heating. FIG. 3 is a diagram showing a relationship (temperature characteristics) between the color optical density and the temperature of the recording material. As shown in FIG. 3, for example, when the temperature of the heat-sensitive recording medium initially in the decolored state A rises, color development starts occurring near temperature T1 in accordance with the graph as indicated by a solid line in the figure. Then, as the temperature reaches temperature T1, the heat-sensitive recording medium assumes the colored state B. When the heat-sensitive recording medium in the colored state B is rapidly cooled, it is shifted to the colored state C, where the colored state C is maintained even at room temperature, in accordance with the graph as indicated by a solid line in the figure. Furthermore, when the heat-sensitive recording medium in the colored state B is slowly cooled, it is decolored in accordance with the graph as indicated by a dotted line in the figure and returns to the decolored state A. On the other hand, when the temperature of the heat-sensitive recording medium in the colored state C rises again, the heat-sensitive recording medium is decolored at temperature T2 lower than temperature T1 in accordance with the graph as indicated by a dashed line in the figure and shifted to the decolored state E. Furthermore, when the temperature of the heat-sensitive recording medium in the decolored state E is lowered, the heat-sensitive recording medium returns to the decolored state A. In this manner, the upper surface of the recording card 70 is heated by the thermal head and the like to thereby make it possible to erase and record information from and on the recording card 70.

Referring back to FIG. 1, the sheet feeding cassette 21 is a box-shaped member the upper side of which is open and in which an opening 21*a* is formed at its bottom wall, and includes a tray 22 that moves in the Z-axis direction inside it. In the tray 22, plural of the recording cards 70 having their longitudinal direction oriented in the X-axis direction are stacked. When the sheet feeding cassette 21 is loaded into the housing 10*a*, the tray 22 is upwardly biased through the opening 21*a* of the sheet feeding cassette 21 by the lifting and lowering mechanism 24 having a pair of rod-shaped members 25A and 25B, which are provided in a manner capable of rising and falling in rotational motions about the axis parallel to the Y-axis centering, for example, around the ends on the negative X-side and the positive X-side. Accordingly, the uppermost recording card 70 among those stacked in the tray 22 is brought into press-contact with the lower surface of the sheet feeding roller 23 supported by a supporting member 23*a*, and then it is supplied into the erasing device 30 through an inserting port 30*a* as the sheet feeding roller 23 rotates.

The erasing device 30 includes a pair of conveying rollers 31 that convey the recording card 70 sequentially fed from the sheet feeding cassette 21 in the positive X-direction, a heating unit 100 arranged on the positive X-side of the pair of conveying rollers 31, a platen roller 33 arranged beneath the heating unit 100, and a movable roller 34 arranged on the positive X-side of the heating unit 100 through a movable member 34*a*.

Figure 4:
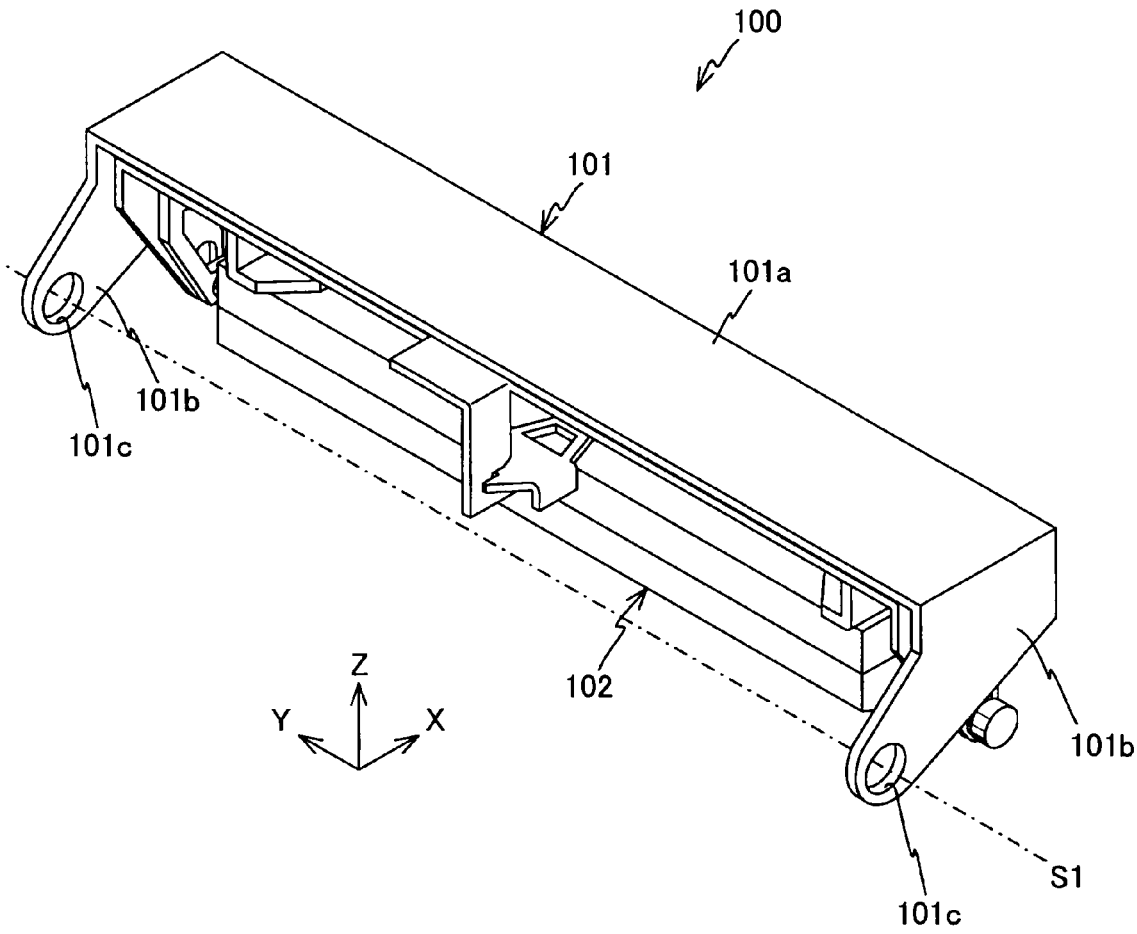
FIG. 4 is a perspective view of a heating unit 100.

FIG. 4 is a perspective view of the heating unit 100. As shown in FIG. 4, the heating unit 100 includes, for example, a rotating member 101 arranged in a manner capable of rotating about the shaft S1 parallel to the Y-axis and a heating head 102 fixed to the rotating member 101.

The rotating member 101 includes a rectangular-plate-shaped main body part 101*a* having its longitudinal direction oriented in the Y-axis direction and a set of supporting parts 101*b* obliquely extending from the ends on the positive Y-side and the negative Y-side of the main body part 101*a* in the downward (negative Z-direction) and negative X-direction. Furthermore, circular openings 101*c* are formed at the ends on the negative X-side of the supporting parts 101*b*. In the rotating member 101*b*, a shaft or the like parallel to the Y-axis is inserted in the openings 101*c* formed in the supporting parts 101*b*, respectively, and the rotating member 101 is arranged in a manner capable of rising and falling in rotational motions about the shaft S1 driven by a rotating mechanism (not shown).

Figure 5:
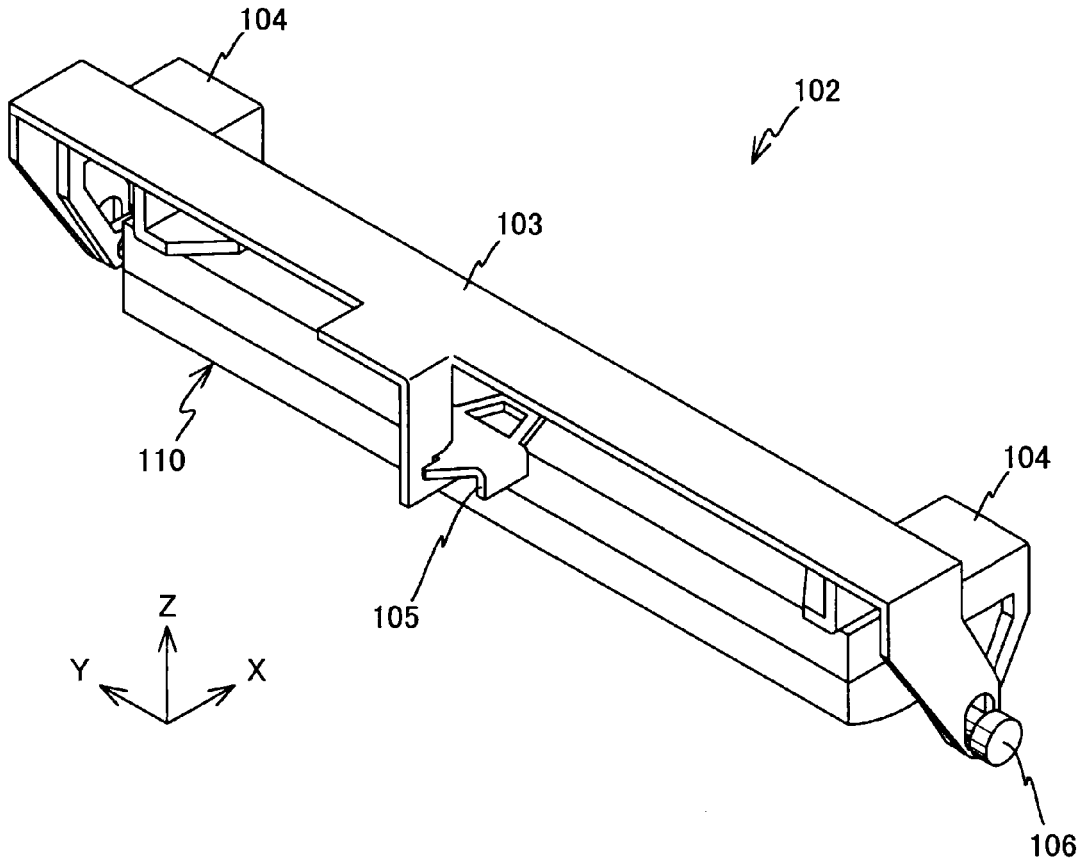
FIG. 5 is a perspective view of a heating head 102.

FIG. 5 is a perspective view of the heating head 102. As shown in FIG. 5, the heating head 102 includes a heating device 110, a base member 103, a set of auxiliary members 104, a braking member 105, and the like.

Figure 6:
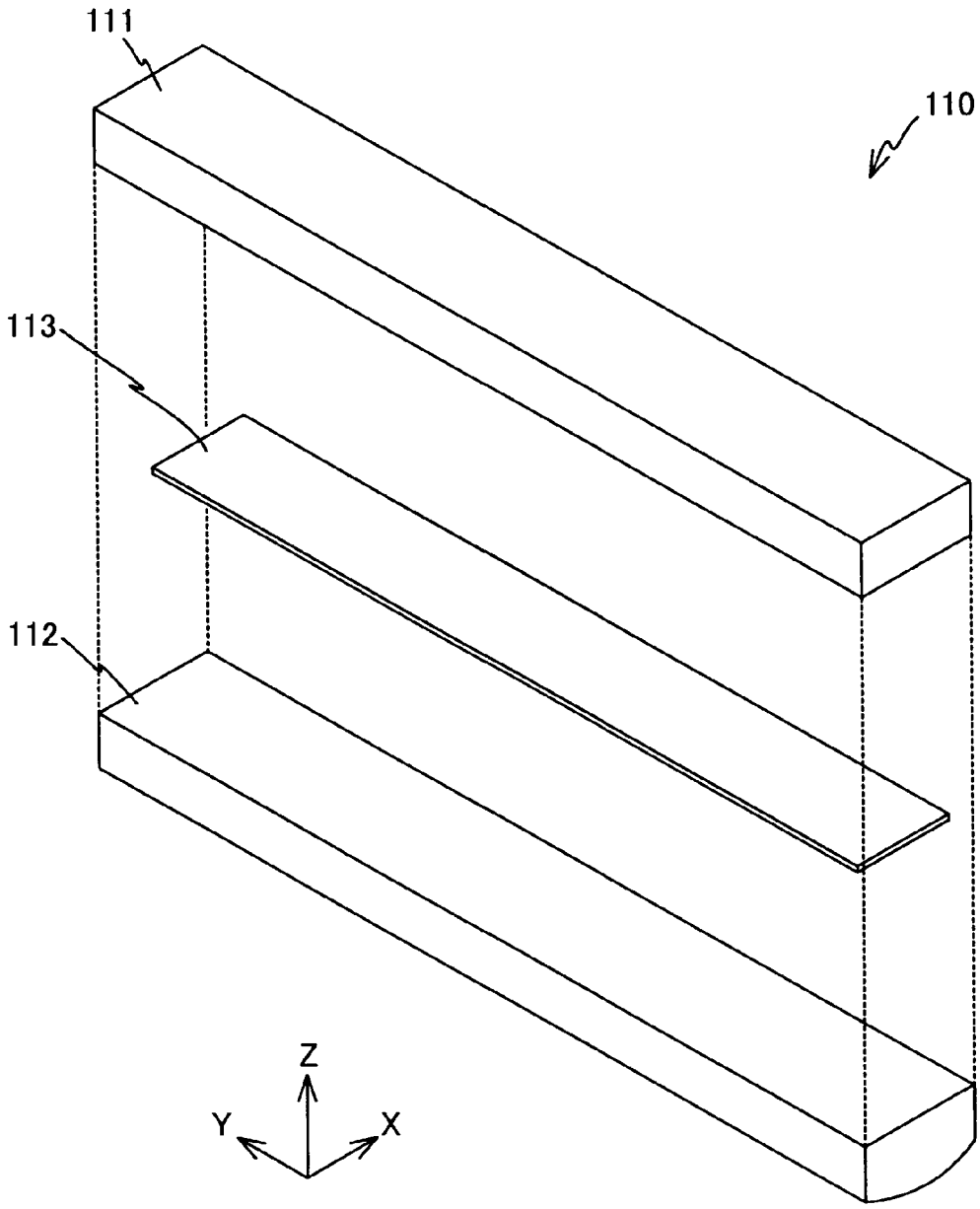
FIG. 6 is an exploded perspective view of a heating device 110.

FIG. 6 is an exploded perspective view of the heating device 110. As shown in FIG. 6, the heating device 110 includes a heat generating member 113 that generates heat in accordance with electric power supplied from the outside, a heat accumulating member 111 arranged on the side of the upper surface of the heat generating member 113, and a heating member 112 arranged on the side of the lower surface thereof.

Figure 7:
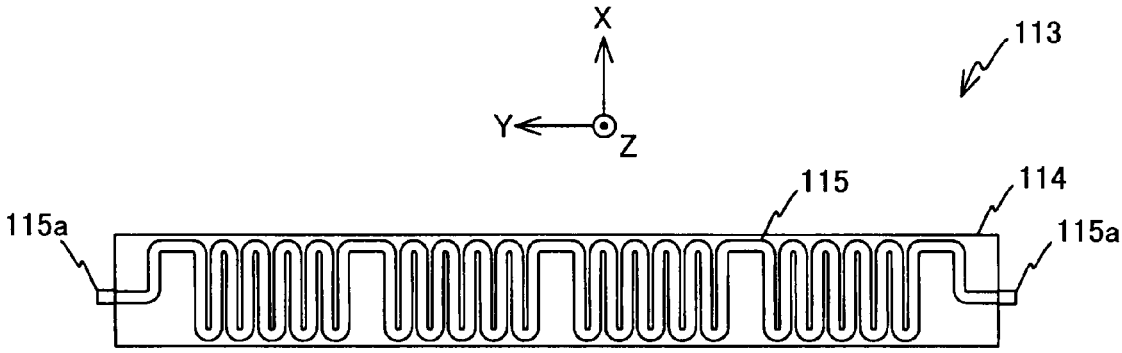
FIG. 7 is a diagram showing a heat generating member 113.

The heat generating member 113 is a sheet heating element having its longitudinal direction oriented in the Y-axis direction. As shown in FIG. 7 as an example, the heat generating member 113 includes a resistor 115 formed by punching out or etching stainless steel foil having a thickness of several microns and a set of polyimide sheets 114 having their longitudinal direction oriented in the Y-axis direction bonded from the sides of the upper and lower surfaces of the resistor 115. A pair of electrodes 115*a* are formed at ends on the positive Y-side and the negative Y-side of the heat generating member 113, and a resistor main body is formed between the electrodes such that it meanders in the X-axis direction. Therefore, the resistor 115 ensures an area (effective area) for discharging a predetermined amount of heat energy. The polyimide sheets 114 are bonded onto the upper and lower surfaces of the resistor 115 to electrically insulate the heat generating member 113.

The heat accumulating member 111 is a rectangular member having its longitudinal direction oriented in the Y-axis direction. As a material for the heat accumulating member 111, for example, aluminum, a metal having a high heat conductivity is used. But, it is not particularly limited so long as metals having a high heat conductivity such as gold, silver, copper, and iron are used.

The heating member 112 is a rectangular member having its longitudinal direction oriented in the Y-axis direction. The lower surface of the heating member 112 has a downward projection and is formed into a curved surface (hereinafter referred also to as a heating surface) having a generating line parallel to the Y-axis. Similarly to the heat accumulating member 111, the heating member 112 uses aluminum as its material and is controlled to have substantially the same a heat capacity as the heat accumulating member 111. Note, however, that the heating member 112 is only required to have high heat conductivity and substantially the same heat capacity as the heat accumulating member 111. Therefore, the material of the heating member 112 is not necessarily the same as that of the heat accumulating member 111.

The heat generating member 113, the heat accumulating member 111, and the heating member 112 configured described above are integrated with each other by mutually fixing the heating member 112 and the heat accumulating member 111 using bolts or the like with the heat generating member 113 held by the heat accumulating member 111 and the heating member 112 from its vertical direction.

Figure 8:
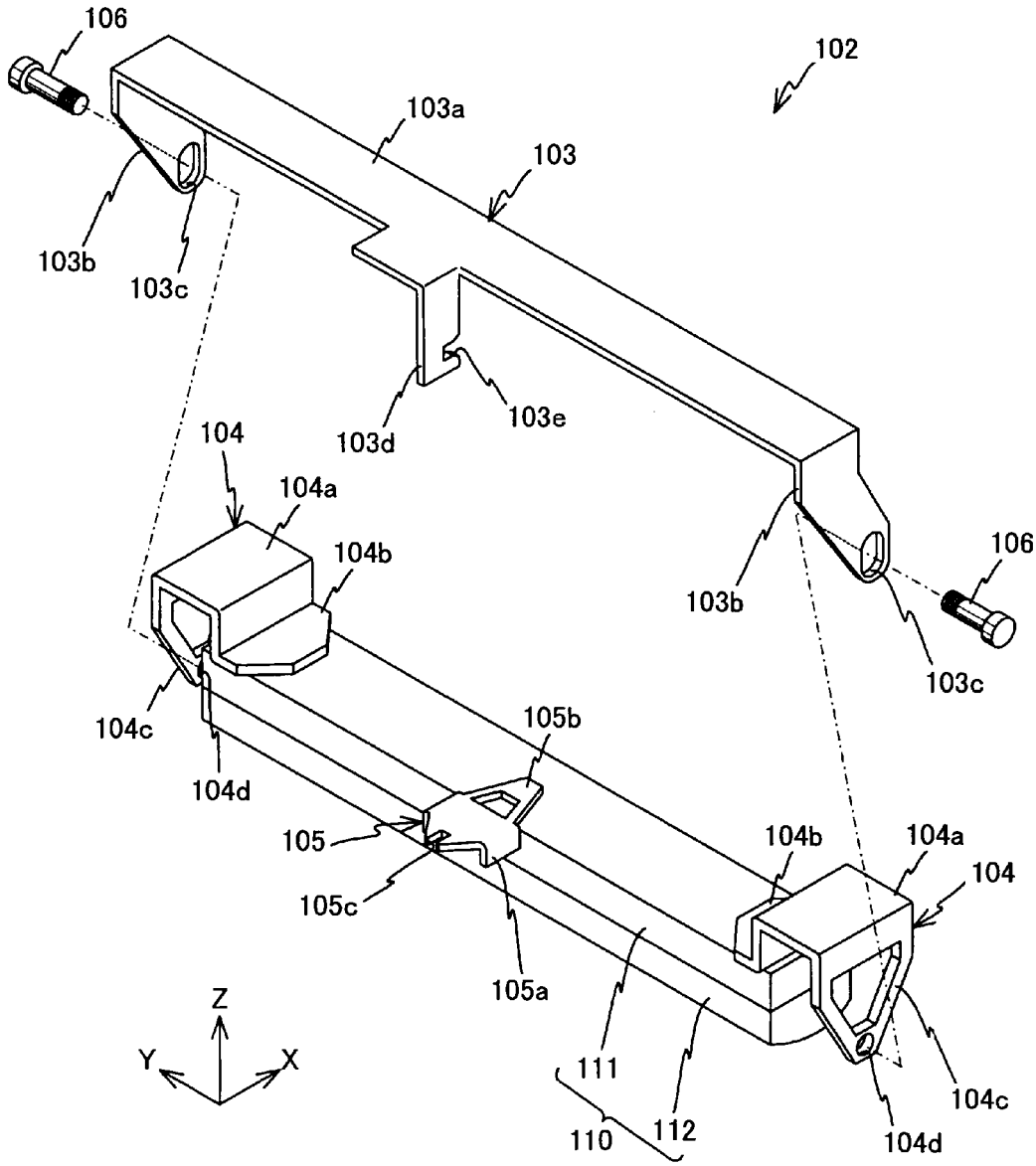
FIG. 8 is an exploded perspective view of the heating head 102.

FIG. 8 is an exploded perspective view of the heating head 102 shown in FIG. 5. The base member 103 is formed by the sheet metal working of metal sheets or the like. As shown in FIG. 8, the base member 103 includes a base part 103*a* having its longitudinal direction oriented in the Y-axis direction, a set of arm parts 103*b* obliquely extending from the positive Y-side and the negative Y-side of the base part 103*a* in the downward (negative Z-direction) and positive X-direction, and a rectangular-plate-shaped braking part 103*d* downwardly extending from the center at the end on the negative X-side of the base part 103*a*. Furthermore, elongated holes 103*c* having their longitudinal direction oriented in the Z-axis direction are formed at the ends on the positive X-side of the arm parts 103*b*. Furthermore, a notch 103*e* is formed slightly to the rear of the center of the braking part 103*d* on the end on the positive X-side.

The set of auxiliary members 104 includes curved parts 104*a* curved in a rectangular shape, substantially triangular fixing parts 104*b* horizontally extending from one end of the curved parts 104*a*, and V-shaped connecting parts 104*c* downwardly extending from the other end of the curved parts 104*a*. Furthermore, threaded round holes 104*d* are formed at the lower ends of the connecting parts 104*c*. The set of auxiliary members 104 is attached to the upper surface of the heat accumulating member 111 at each of the ends on the positive Y-side and the negative Y-side by screws, rivets, or the like with the round holes 104*d* positioned on the positive Y-side and the negative Y-side of the heating member 112.

The braking member 105 is a member including three parts of a slit 105*c* formed by a set of claw parts extending in the negative X-direction, a guide part 105*a* having a pair of downwardly extending contact parts, and a V-shaped fixing part 105*b* extending from the end on the positive X-side of the guide part 105*a* to the positive X-direction. The braking member 105 is fixed to the center of the heat accumulating member 111 by screws, rivets, or the like to be attached to the heat accumulating member 111 with the pair of contacting parts brought into contact with the surface on the negative X-side of the heat accumulating member 111.

Considering all the parts together based on FIGS. 5 and 8, the heating device 110 is rotatably connected to the base part 103 by screwing the tip ends of the bolts 106 into the threaded round holes 104*d* formed in the auxiliary members 104 through the elongated holes 103*c* formed in the arm parts 103*b* of the base member 103 while making the slit 105*c* formed in the braking member 105 fit in the notch 103*e* formed in the braking part 103*d* of the base member 103. Note, however, that in the embodiment the rotating range of the heating device 110 relative to the base member 103 is limited to, for example, about two through three degrees and the position of the heating device 110 in the Y-axis direction relative to the base member 103 is regulated. Furthermore, the heating device 110 is allowed to move in the Z-axis direction and rotate about the X-axis within a limit where the bolts 106 slide in the elongated holes 103*c* of the base member 103.

Figure 9A:
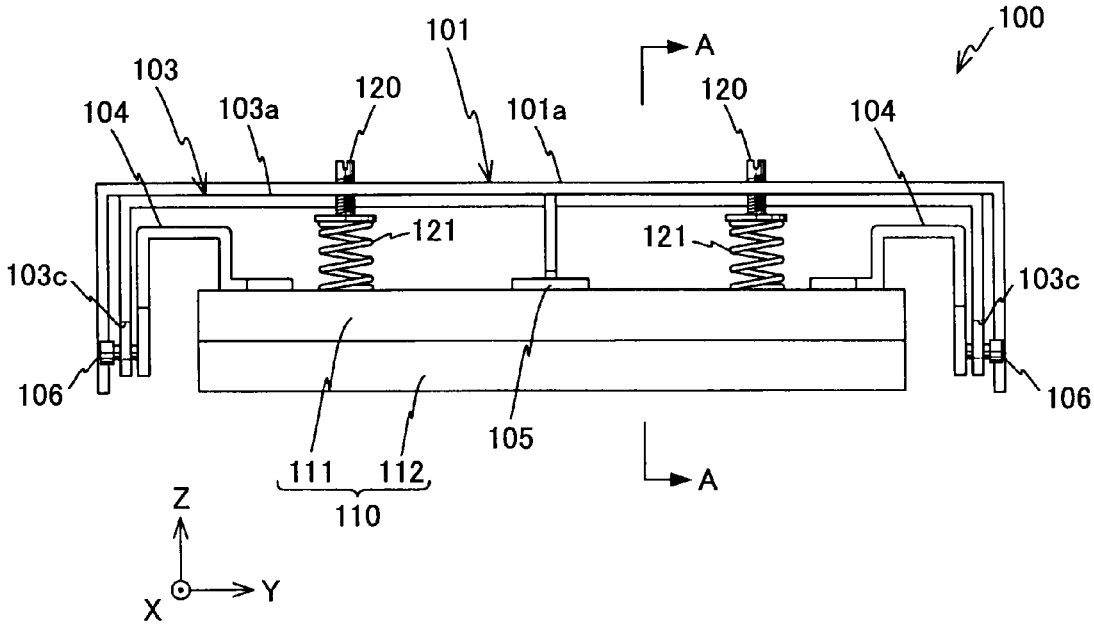
FIGS. 9A and 9B are respectively a side view of the heating unit 100 and a cross-sectional view thereof taken along line A-A in FIG. 9A.
Figure 9B:
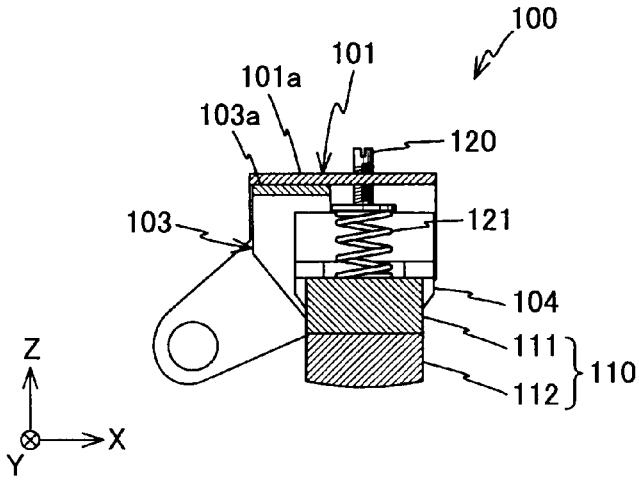

FIGS. 9A and 9B are respectively a side view of the heating unit 100 and a cross-sectional view thereof taken along line A-A in FIG. 9A. As shown in FIGS. 9A and 9B, the heating head 102 integrated as described above is attached to the rotating member 101 in such a manner that the lower surface of the main body part 101*a* of the rotating member 101 and the upper surface of the base part 103*a* of the base member 103 are fixed by screws or the like with their ends on the negative X-side aligned with each other.

Figure 10A:
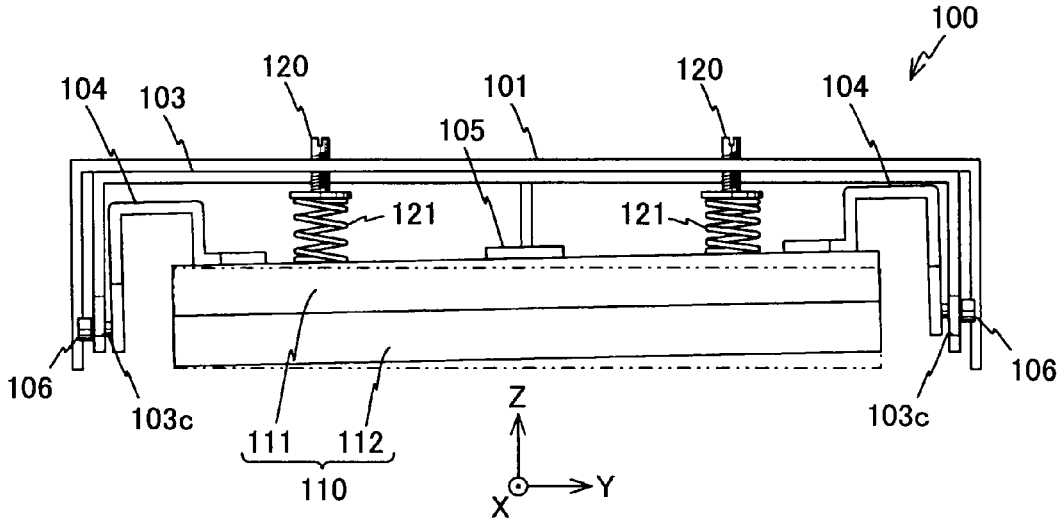
FIGS. 10A and 10B are diagrams for explaining the operations of the heating device 110.
Figure 10B:
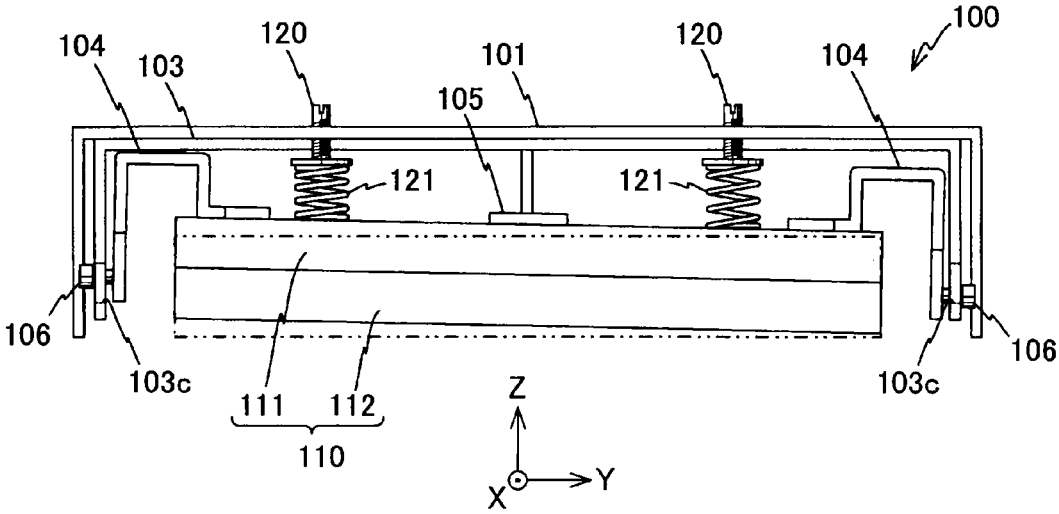

Furthermore, a set of adjusting screws 120 are screwed into the main body part 101*a* of the rotating member 101 in a manner capable of moving in the Z-axis direction, and pressurizing springs 121 that downwardly bias the upper surface of the heat accumulating member 111 are attached at the ends of the adjusting screws 120. The adjusting screws 120 are screwed to adjust the biasing force of the pressurizing springs 121 to apply an appropriate biasing force onto the upper surface of the heat accumulating member 111, whereby the heating device 110 is constantly positioned at the lower limit of the movable range defined by the bolts 106 and the elongated holes 103*c*. When a material to be heated such as a heat-sensitive recording medium is brought into press-contact with the heating member 112 of the heating device 110, the heating device 110 is obliquely positioned inclined as shown in FIG. 10A or FIG. 10B so that the lower surface of the heating member 112 is brought into satisfactory contact with the material to be heated.

When the recording card 70 is fed from the sheet feeding cassette 21, the erasing device 30 including the heating unit 100 rotates the rotating member 101 of the heating unit 100 to bring the heating member 112 of the heating device 110 into contact with the upper surface of the recording card 70 supported from the underside by the platen roller 33. Then, electric power is supplied to the heat generating member 113 of the heating device 110 while the pair of conveying rollers 31 is driven to feed the recording card 70 in the positive X-direction. Accordingly, the upper surface of the recording card 70 is heated to a temperature higher than or equal to temperature T2 in FIG. 3 to erase information recorded on the recording card 70.

Referring back to FIG. 1 again, the recording device 50 includes a recording head 52 arranged above (on the positive Z-side of) the erasing device 30 and liftably supported by supporting members (not shown), a platen roller 53 arranged beneath the recording head 52, a drawing roller 51 that is arranged on the positive X-side of the recording head 52 and draws the recording card 70 conveyed through the lifter 40 into a gap between the recording head 52 and the platen roller 53, and first and second discharging rollers 54 and 55 vertically arranged close to each other on the negative X-side of the recording head 52.

When the end on the negative X-side of the recording card 70 is drawn into the gap between the recording head 52 and the platen roller 53, the recording device 50 heats the upper surface of the recording card 70 to temperatures higher than or equal to temperature T1 to record other information on it while driving the platen roller 53 to feed the recording card 70 in the negative X-direction with the recording head 52 brought into contact with the upper surface of the recording card 70 supported from the underside by the platen roller 53. On the other hand, the drawing roller 51 and the first discharging roller 54 are arranged through supporting members 51*a* and 54*a*, respectively, capable of vertically moving with a driving mechanism (not shown), and they are withdrawn at a position free from the interference with the recording card 70 when the information is being recorded on the recording card 70. Upon completion of the information recording on the recording card 70, the first discharging roller 54 is brought into contact with the upper surface of the recording card 70 to hold the recording card 70 with the first and second discharging rollers 54 and 55. Then, the second discharging roller 55 is rotated to sequentially discharge the recording card 70 to the sheet discharging tray 60 through a discharging port 50*a* formed in the housing 10*a*.

Inside the housing 10*a*, the lifter 40 includes a lifting and lowering device 41 arranged on the positive X-side of the erasing device 30, a conveying tray connected to the lifting and lowering device 41 through link bars 44A and 44B, and a carrying-in-and-out roller 47 having its longitudinal direction oriented in the Y-axis direction arranged near the end on the negative X-side of the conveying tray 42.

The lifting and lowering device 41 having its longitudinal direction oriented in the X-axis direction is arranged at the bottom wall surface of the housing 10*a* through supporting members (not shown). It includes a moving shaft 45A that moves along a guide slot 41*a* having its longitudinal direction oriented in the X-axis direction formed from the end on the negative X-side to a central part and a moving shaft 45B that moves along a guide slot 41*b* having its longitudinal direction oriented in the X-axis direction formed from the end on the positive X-side to a central part.

The link bar 44A has a curved shape so as to be upwardly projected. The end on the positive X-side of the link bar 44A is attached at an upper position of the end on the positive X-side of the conveying tray 42 in a manner capable of rotating about the shaft parallel to the Y-axis, and the end on the negative X-side thereof is attached to the moving shaft 45A provided in the lifting and lowering device 41 in a manner capable of rotating about a shaft parallel to the Y-axis. Furthermore, the link bar 44B has the same configuration as the link bar 44A. That is, the end on the negative X-side of the link bar 44B is attached at an upper position of the end on the negative X-side of the conveying tray 42 in a manner capable of rotating about a shaft parallel to the Y-axis, and the end on the positive X-side thereof is attached to the moving shaft 45B provided in the lifting and lowering device 41 in a manner capable of rotating about the shaft parallel to the Y-axis.

In the lifter 40, the conveying tray 42 is lowered to be set at the position as indicated by solid lines in FIG. 1 as the moving shaft 45A and the moving shaft 45B are moved in the negative X-direction and the positive X-direction, respectively, by the lifting and lowering device 41. Furthermore, the conveying tray 42 is raised to be set at the position as indicated by imaginary lines in FIG. 1 as the moving shaft 45A and the moving shaft 45B are moved in the positive X-direction and the negative X-direction, respectively, by the lifting and lowering device 41. For the sake of convenience in explanation, the position as indicated by the solid lines in FIG. 1, where the conveying tray 42 is set, is defined as the carry-in position and that as indicated by the imaginary lines in FIG. 1, where the conveying tray 42 is set, is defined as the carry-out position.

Next, a description is made of the operations of the printer 10 configured as described above. Assume that plural of the recording cards 70 are accommodated in the sheet feeding cassette 21 in advance and the tray 22 is upwardly biased by the lifting and lowering mechanism 24. Furthermore, assume that the conveying tray 42 is set at the position as indicated by the solid lines in FIG. 1 and the respective parts of the printer 10 are entirely controlled by a control unit (not shown).

(Sheet Feeding Process)

Upon receipt of operating instructions from the user or higher level devices, the control unit rotates the sheet feeding roller 23 to feed the recording card 70 accommodated in the sheet feeding cassette 21 in the positive X-direction, so that the recording card 70 is conveyed into a gap between the pair of conveying rollers 31 of the erasing device 30 through the inserting port 30*a*.

(Erasing Process)

When the recording card 70 is conveyed to the erasing device 30, the control unit heats the upper surface of the recording card 70 with the heating unit 100 while moving the recording card 70 in the positive X-direction through the pair of conveying rollers 31 and the platen roller 33, to thereby erase information recorded on the recording card 70.

(Carrying-In Process into Lifter)

When the end on the positive X-side of the recording card 70 moving in the positive X-direction passes through the position above the carrying-in-and-out roller 47 provided in the conveying tray 42, the control unit rotates the movable member 34*a* to bring the movable roller 34 into contact with the upper surface of the recording card 70, so that the movable roller 34 and the carrying-in-and-out roller 47 cooperate with each other to carry the recording card 70 into the conveying tray 42.

(Lifting-Up Process)

After the recording card 70 is carried into the conveying tray 42, the control unit drives the lifting and lowering device 41 to start lifting the conveying tray 42. In the printer 10 according to the embodiment, time required for the conveying tray 42 starting its movement from the carry-in position to reach the carry-out position is about 1 through 2 seconds.

(Carrying-Out Process from Lifter)

When the conveying tray 42 is at the carry-out position, the control unit drives the supporting member 51*a* to bring the drawing roller 51 into contact with the upper surface of the recording card 70, so that the drawing roller 51 and the carry-in-and-out roller 47 cooperate with each other to convey the end on the negative X-side of the recording card 70 into a gap between the recording head 52 and the platen roller 53.

(Recording Process)

When the recording start position of the recording card 70 moving in the negative X-direction is positioned just beneath the recording head 52, the control unit lowers the recording head 52 to hold the recording card 70 with the recording head 52 and the platen roller 53 while moving the supporting members 51*a* and 54*a* upward to withdraw the drawing roller 51 and the first discharging roller 54 to a position free from interference with the recording card 70. Then, the recording card 70 is moved relative to the recording head 52 only by the platen roller 53 to start recording of other information on the recording card 70. At the same time, when the printing is started on the recording card 70, the control unit moves the conveying tray 42 to the carry-in position so as to be in standby.

(Sheet Discharging Process)

The recording card 70 on which other information has been recorded is discharged through the discharging port 50*a* by the first and second discharging rollers 54 and 55 and then sequentially stacked in the sheet discharging tray 60.

As described above, in the heating unit 100 according to the embodiment, the heating device 110 that heats the recording card 70 is directly held to the base member 103 through the auxiliary members 104 fixed to the heat accumulating member 111 by bolts or the like. Accordingly, it is not necessary to use a heat-sensitive adhesive required when typical heating devices are used, thereby making it possible to simplify the structure of the apparatus and reduce manufacturing costs. Furthermore, because the lack of an adhesive allows the heating device 110 to be easily detached or attached from or to the heating head 102, maintenance of the apparatus is facilitated.

Furthermore, the heating device 110 is held to the base member 103 through the auxiliary members 104 fixed at both ends of the heat accumulating member 111. Therefore, even if the heat accumulating member 111 or the like is expanded by heat, no excessive force is applied to the heating device 110. Moreover, the heat accumulating member 111, the auxiliary members 104, the base member 103, and the like are made of either the same material or materials having a similar thermal expansion coefficient, thereby making it possible to effectively reduce the influence due to thermal expansion.

Furthermore, in the heating device 110 of the heating unit 100 according to the embodiment, the heat generating member 113 is held by the heat accumulating member 111 and the heating member 112 having higher rigidity compared with typical thermal heads and ceramics used in erasing heads. Accordingly, it is possible to hold only a part of the heat accumulating member 111. Therefore, by reducing the contact area between the auxiliary members 104 and the heat accumulating member 111 to be as small as possible, the amount of heat transferred from the heat accumulating member 111 through the auxiliary members 104 can be reduced. As for the contact area between the auxiliary members 104 and the heat accumulating member 111, it is preferable that the proportion of the contact area to the upper surface area of the heat accumulating member 111 be smaller than or equal to 0.5.

Furthermore, the ends of the heating device 110 of the heating unit 100 according to the embodiment are held in a manner capable of freely moving up and down. Therefore, as shown in FIGS. 10A and 10B, the heating device 110 controls its attitude to be properly brought into contact with the upper surface of the recording card 70. Accordingly, it is possible to uniformly heat the recording card 70.

In the embodiment, a case is described where the auxiliary members 104 are directly attached to the heat accumulating member 111. Alternatively, a spacer or the like may be provided between the heat accumulating member 111 and the auxiliary members 104 so that the auxiliary members 104 are attached to the heat accumulating member 111. Furthermore, screws, pins, rivets, or the like other than bolts may be used to connect the heat accumulating member 111 and auxiliary members 104 to each other. Moreover, the tip ends of the bolts 106 may be directly screwed into threads in the heat accumulating member 111 so that the heating device 110 is rotatably connected to the base member 103.

Figure 11:
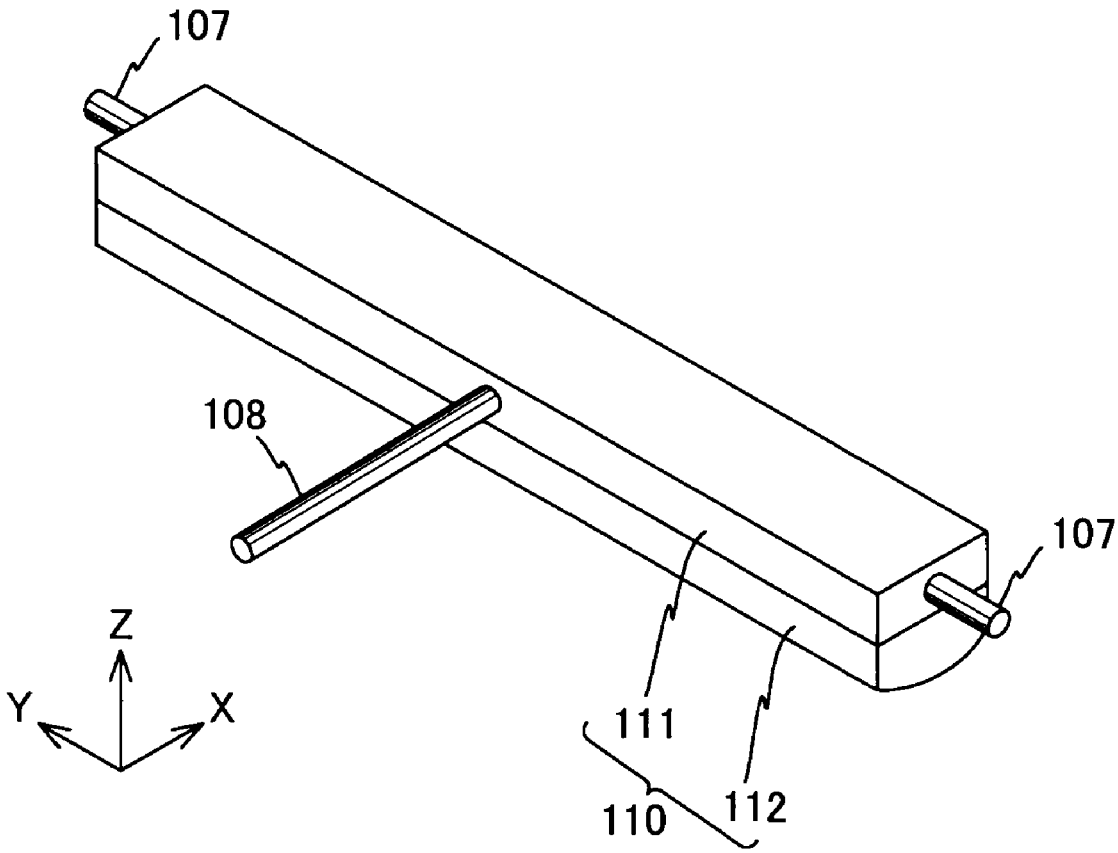
FIG. 11 is a diagram showing a modified example of the heating device 110.

Specifically, as shown in FIG. 11, pins 107 are provided at surfaces on the positive Y-side and the negative Y-side of the heat accumulating member 111 so as to be rotatably supported by the base member 103. Note that a rod-shaped member 108 in FIG. 11 is attached to the heat accumulating member 111 to regulate the rotational motion of the heating device 110.

Furthermore, when the recording card 70 is heated by the heating unit 100 according to the embodiment, the heat from the heat generating member 113 is first transferred to the heating member 112. Because the heating member 112 is made of aluminum having high heat conductivity in the embodiment, the temperature distribution of the heating surface of the heating member 112 becomes uniform regardless of the shape and the heat distribution of the resistor 115. The recording card 70 receives the heat energy from the heating surface to be heated thereby. Accordingly, the recording surface of the recording card 70 can be uniformly heated.

Furthermore, in the heating unit 100 according to the embodiment, the heat accumulating member 111 having a heat capacity equivalent to the heating member 112 is provided in a manner as to be brought into contact with the upper surface of the heat generating member 113. Accordingly, even if high electric power is supplied to the heat generating member 113 at the time of booting the printer 10 or the like to rapidly raise the temperature of the heating member 112 from room temperature of about 25° C. to a standby temperature of 70° C., nearly the same amount of heat is discharged from the upper and lower surfaces of the heat generating member 113, thereby making it possible to prevent damage due to overheating the heat generating member 113.

Furthermore, the heat accumulating member 111 properly compensates for the amount of heat discharged from the heating member 112 at the time of heating. Therefore, it is possible to reduce the variation in temperature of the heating surface when the recording cards 70 are heated by the heating member 112 in a continuous manner.

Furthermore, the heating unit 100 according to the embodiment includes the heat accumulating member 111 and the heating member 112 having high heat capacity and high heat conductivity. Therefore, even if the recording cards 70 are heated in a continuous manner, the variation in temperature of the heating surface of the recording cards 70 is reduced to a small amount, thereby making it possible to reduce the supplied amount of electric power as a whole.

Furthermore, in the erasing device 30 according to the embodiment, the previous information recorded on the recording card 70 is erased using the heating unit 100. Accordingly, it is possible to uniformly heat the recording card 70 to evenly erase the recorded information.

Furthermore, in the printer 10 according to the embodiment, the erasing device 30 erases the previous information recorded on the recording card 70 using the heating unit 100. Accordingly, it is possible to evenly erase the recorded information. Furthermore, the recording device 50 records other information on the recording card 70 from which the previous information has been evenly erased, thereby making it possible to accurately record other information on the recording card 70.

The above embodiment describes the case where the previous information is erased from the recording card 70 in the printer 10, but it is not limited to the recording card 70. Alternatively, heat-sensitive recording sheets may be used.

Furthermore, the heat-sensitive characteristics of the recording card 70 shown in FIG. 3 are given for exemplification purposes, and a recording card having other heat-sensitive characteristics may be used. In this case, it is possible to deal with the heat-sensitive characteristics by setting heating temperatures using the erasing device 30 and the recording device 50 as appropriate.

In the embodiment, aluminum is used as a material for the heat accumulating member 111 and the heating member 112, but the material is not limited to aluminum. Alternatively, metal materials such as copper having high heat conductivity may be used, and the heat accumulating member 111 and the heating member 112 may be integrated with each other. Furthermore, when a recording medium to be recorded on is of a rigid material, its abrasion resistance may be improved by nickelizing the heating surface or the like.

Furthermore, in the embodiment, the sheet heating element is used as the heat generating member 113, but the heat generating member 113 is not limited to the sheet heating element. For example, a resistance having an insulating film such as an oxidized film formed thereon may be cast in the heating member.

Furthermore, in the printer 10 according to the embodiment, the heating unit 100 is used as the erasing head, but it is not limited to the erasing head in the present invention. It may be also applied to a transfer device that transfers ink or the like onto a recording medium, a laminator, or the like.

As described above, the heating unit according to the embodiment of the present invention is suitable for heating a heat-sensitive medium. Furthermore, the erasing device according to the embodiment of the present invention is suitable for erasing information recorded on a heat-sensitive recording medium having heat reversibility. Furthermore, the information erasing and recording apparatus according to the embodiment of the present invention is suitable for erasing and recording information from and on a heat-sensitive recording medium having heat reversibility.

The present invention is not limited to the specifically disclosed embodiments, and variations and modifications may be made without departing from the scope of the present invention.

The present application is based on Japanese Priority Application No. 2007-099383 filed on Apr. 5, 2007, the entire contents of which are hereby incorporated herein by reference.

What is claimed is:

1. A heating unit that heats a heat-sensitive medium, comprising:

a heat generating body that converts electric energy into heat energy;

a fixed member to which the heat generating body is fixed; and a holding member that includes a set of first members connected to at least two different places on the fixed member and a second member movably holding the first members in a predetermined direction and wherein the holding member directly holds the fixed member while contacting at least a part of the fixed member;

a braking member that connects the fixed member and the second member to each other; and a pressurizing spring that connects the fixed member and the second member to each other.

2. The heating unit according to claim 1, wherein the holding member holds the part of the fixed member.

3. The heating unit according to claim 1, wherein the second member rotatably holds the first members.

4. The heating unit according to claim 1, wherein the second member includes a regulating part that regulates a rotating range of the heating unit.

5. The heating unit according to claim 1, wherein a proportion of areas of connected surfaces of the fixed member with which the first members are brought into contact to an area of a whole connected surface of the fixed member to which the first members are connected is smaller than or equal to 0.5.

6. The heating unit according to claim 1, wherein the first members and the fixed member are connected to each other by a screw or a pin.

7. The heating unit according to claim 1, wherein the first members are made of a metal.

8. The heating unit according to claim 1, wherein the first members and the second member are configured to be separated from each other.

9. An erasing device that erases information recorded on a heat-sensitive recording medium heat-reversibly developing and erasing a color, the device comprising:

the heating unit according to claim 1 that heats the heat-sensitive recording medium to erase the information; and a moving device that moves the heat-sensitive recording medium relative to the heating unit.

10. An information erasing and recording apparatus that erases and records information from and on a heat-sensitive recording medium heat-reversibly developing and erasing a color, the apparatus comprising:

the erasing device according to claim 9 that heats the heat-sensitive recording medium to erase information recorded on the heat-sensitive recording medium; and a recording device that records other information on the heat-sensitive recording medium from which the previous information has been erased by the erasing device.

11. The heating unit according to claim 1, wherein the braking member is disposed between two of the first members.

* * * * *